US006779862B2

(12) United States Patent
Elgee

(10) Patent No.: US 6,779,862 B2
(45) Date of Patent: Aug. 24, 2004

(54) SYSTEM AND METHOD OF PROVIDING POWER TO A PRINT HEAD

(75) Inventor: Steven B. Elgee, Portland, OR (US)

(73) Assignee: Hewlett-Packard Development, L.P., Houston, TX (US)

( * ) Notice: Subject to any disclaimer, the term of this patent is extended or adjusted under 35 U.S.C. 154(b) by 0 days.

(21) Appl. No.: 10/243,336

(22) Filed: Sep. 12, 2002

(65) Prior Publication Data

US 2004/0051749 A1 Mar. 18, 2004

(51) Int. Cl.[7] ..... B41J 29/38
(52) U.S. Cl. ..... 347/14; 347/19
(58) Field of Search ..... 347/14, 19, 15, 347/43, 37, 9, 10, 11

(56) References Cited

U.S. PATENT DOCUMENTS 4,425,612 A 1/1984 Bahler et al.
5,528,125 A 6/1996 Marshall et al.
6,068,360 A 5/2000 Hiwada
6,183,056 B1 2/2001 Corrigan et al.
6,213,595 B1 4/2001 Anagnostopoulos et al.
6,366,224 B2 4/2002 Cliff et al.
6,366,520 B1 4/2002 Huber

*Primary Examiner*—Lamson D Nguyen

(57) ABSTRACT

A printer can anticipate the power needs of a print head. The printer receives a print job and a measurement of print density as a function of time for the print job from a printer driver that determines print density as a function of time based on data representing the print job. The printer includes a processor for receiving a print job, a print head and a power system for supplying power to said print head. The processor controls a voltage applied by the power system to the print head in accordance with the measurement of print density.

47 Claims, 6 Drawing Sheets

SYSTEM AND METHOD OF PROVIDING POWER TO A PRINT HEAD

BACKGROUND OF THE INVENTION

Ink jet printing mechanisms use a print head (also call a "pen") that shoots droplets of ink or colorant onto a printable surface to generate an image. Such mechanisms may be used in a wide variety of applications, including printers, plotters, copiers, and facsimile machines. As used herein, and in the appended claims the term "printer" or "printing device" will be understood to refer to all devices that incorporate an ink jet printing mechanism and output a hardcopy product.

An ink jet printer typically includes a print head having a multitude of independently addressable firing units. Each firing unit includes an ink chamber connected to a common ink source, and an ink outlet nozzle. A transducer within the chamber provides the impetus for expelling ink droplets through the nozzles. In thermal ink jet printers, the transducers are firing resistors that generate sufficient heat during application of a brief voltage pulse to vaporize a quantity of ink sufficient to expel a liquid droplet from the outlet nozzle.

The energy applied to a firing resistor affects performance, durability, and efficiency. When sufficient firing energy is applied, a vapor bubble forms or nucleates to expel an ink drop. Above this threshold, in a transitional range, increasing the firing energy increases the drop volume expelled. Above a higher threshold, at the upper limit of the transitional range, drop volumes are substantially constant with increasing firing energy. It is in this range, in which drop volumes are stable even with moderate energy variations, that printing ideally takes place. This is because variations in drop volume cause inconsistencies in the printed output and thereby degrade print quality. As energy levels increase above this optimal zone, uniformity is not compromised, but energy is wasted. Moreover, the printer components are prematurely aged due to excessive heating and ink residue build up.

In general, the power or current required for each print job is unknown and depends upon the characteristics of the print job. Print jobs may vary from a relatively small amount of print data, where the print head will not need to draw much current to execute the print job, to a large amount of print data which may require the print head to draw large amounts of current. Additionally, there may be relatively sudden shifts in the amount of data being printed as the print head moves from a relatively blank part of the print job to a more densely printed area. A step load is a substantially instantaneous and significant increase in the amount of current being drawn by the print head due to the demands of the data being printed.

In order to reduce the likelihood of the overall voltage dropping below the threshold needed to properly operate the ink jet pens, the ink jet pens could be operated at a level above the minimum threshold. Operating at this increased voltage level compensates for the potential drop in voltage attributable to a step load or similar event, which is the worst-case scenario. However, this constant, unnecessarily high voltage wastes energy and increases print head temperature thereby reducing the life of the print head.

SUMMARY OF THE INVENTION

In one of many possible embodiments, the present invention may be a method of providing power to a print head by determining a printing density at times throughout a print job based on data representing the print job, transmitting a measurement of the printing density to a printer and controlling the power applied to the print head in accordance with the measurement of the printing density.

In another possible embodiment, the present invention may be a printer that can anticipate the power needs of a print head. The printer receives a print job and a measurement of print density as a function of time for the print job from a printer driver that determines print density as a function of time based on data representing the print job. The printer includes a processor for receiving a print job, a print head and a power system for supplying power to said print head. The processor controls a voltage applied by the power system to the print head in accordance with the measurement of print density.

BRIEF DESCRIPTION OF THE DRAWINGS

The accompanying drawings illustrate preferred embodiments of the present invention and are a part of the specification. Together with the following description, the drawings demonstrate and explain principles of embodiments of the present invention. The illustrated embodiments are examples of the present invention and do not limit the scope of the invention.

Throughout the drawings, identical reference numbers designate similar, though not necessarily identical, elements.

DETAILED DESCRIPTION OF THE PREFERRED EMBODIMENTS

Figure 6:
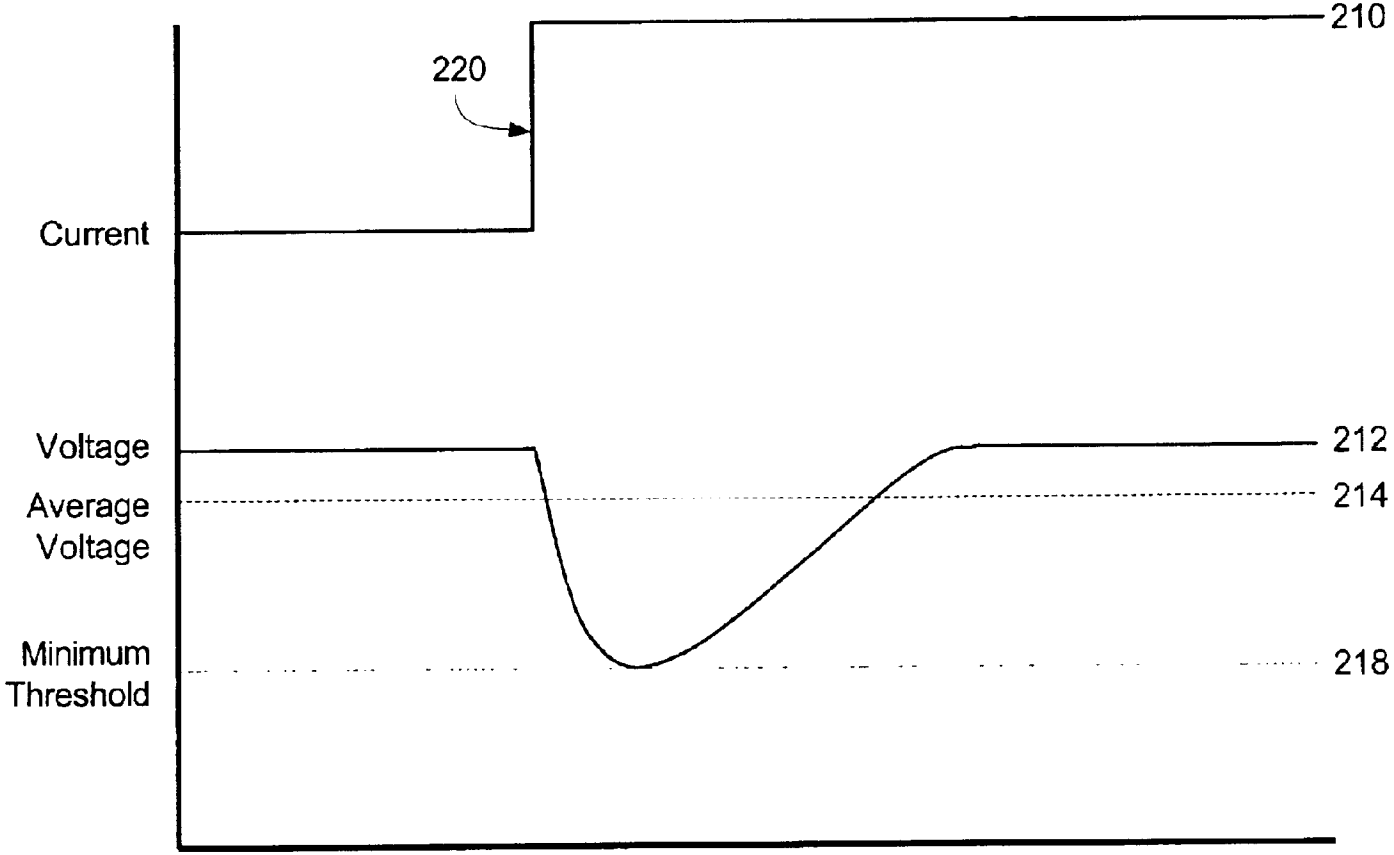
FIG. 6 is graph showing an internal voltage and current condition plotted against time according to the prior art.

FIG. 6 demonstrates how existing systems operate to compensate for a potentially large draw on current that may occur during a print job. In existing systems, the draw on the current may vary from very light to extremely heavy depending on the amount of print data included in the specified print job. Since the draw on the current often varies and is unknown at the time of printing, conventional systems anticipate the worst-case scenario by continuously keeping the voltage level (212) at a high enough level to compensate for the possible occurrence of a step load (220). When the step load (220) or a similar load is impressed upon the print head, the voltage (212) is reduced according to the increased draw on the current (210). Because the print head was operating at such a high voltage it is able to sustain the increased draw on the current (210) without dropping below the minimum threshold (218) required to effectively operate the thermal print head.

While this solution will prevent the voltage level (212) from dropping below the minimum threshold voltage (218) required to effectively operate the print head, keeping the voltage level (212) at this high level increases the overall average voltage level (214). Associated with the increased average voltage level (214) are all of the shortcomings already mentioned including wasted energy, increased print head temperature and reduced print head life.

An embodiment of the present invention includes a method of providing power to a print head by determining a printing density at times throughout a print job based on data representing the print job, transmitting a measurement of the printing density to a printer and controlling the power applied to the print head in accordance with the measurement of the printing density.

The determination of printing density can be performed by counting a number of dots that will be used to print the print job data at times throughout the print job. A printer driver executing on a host that submits the print job to the printer preferably generates the determination of the printing density throughout a print job.

Controlling the voltage applied to the print head preferably includes increasing the voltage applied to the print head prior to printing a portion of the print job having an increased measurement of printing density, and decreasing the voltage applied to the print head after printing the portion of the print job having an increased measurement of printing density.

Controlling the voltage applied to the print head is preferably performed by inputting the measurement of the printing density to an algorithm executed by a processor in the printer. The algorithm outputs an indication of a voltage level corresponding to the measurement of print density at times throughout the print job. The indication of voltage level is then used to regulate the voltage applied to the print head.

Figure 1:
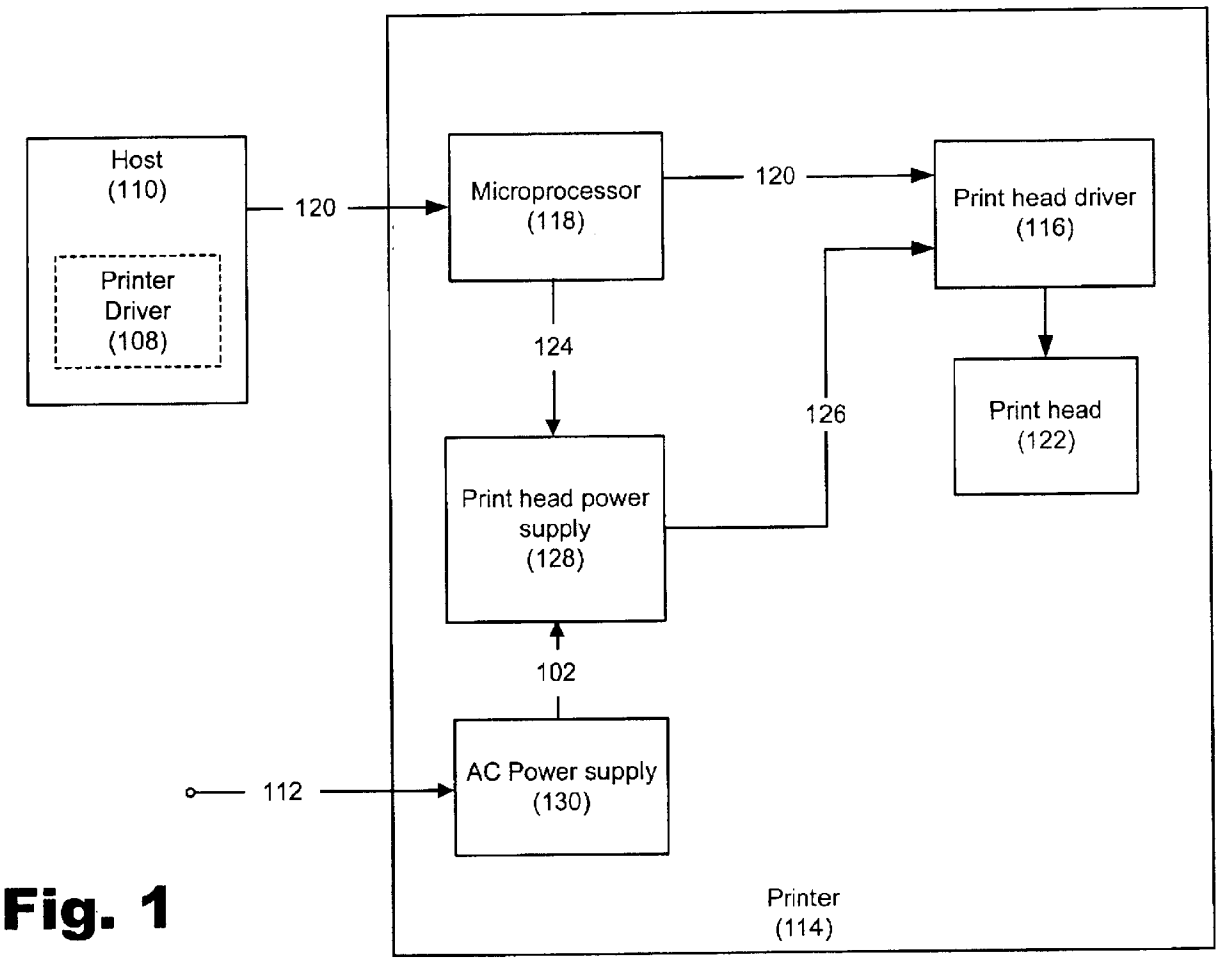
FIG. 1 is a schematic block diagram of an ink jet printing device according to an embodiment of the invention.

FIG. 1 illustrates an embodiment of a system for reducing the average voltage set point of a power supply according to principles of the embodiment of the present invention. As shown in FIG. 1, such a voltage reducing system is preferably implemented in a printer (114). Although, the present invention has other applications.

The printer (114) receives print job data from a host system (110) and prints a hardcopy product from that print job data. The printer (114) preferably contains, or has access to, a supply of a print medium, such as paper, on which print jobs can be printed. The printed product is then output by the printer (114).

The host system (110) may be a computer or a computer network that sends print jobs to the printer (114) for execution. The host (110) can be, for example, a personal computer or other device connected directly to the printer (114). Alternatively, the host (110) may be a number of computers, servers or other devices connected to the printer (114) through a network such as a Local Area Network (LAN), Wide Area Network (WAN), the Internet, a wireless network, etc. Any configuration in which one or more host devices communicate print job data to the printer (114) can benefit from implementation of embodiments of the present invention.

The printer (114) preferably includes a microprocessor (118) that processes print job data (120) from the host (110) and controls the operation of the printer (114). The printer (114) also preferably includes a print head (122) and a print head driver (116). The print head driver (116) positions and drives the print head (112). The print data (120) is passed from the microprocessor (118) to the print head driver (116).

These internal components of the printer (114) are powered by a system which includes a power cord (112), an alternating current (AC) power supply (130) and a print head power supply (128). This power system will be explained in further detail below.

The printer (114) receives power through the power cord (112). This power cord (112) is, for example, connected to a wall outlet in a home or office where the printer (114) is located. Consequently, the power provided through cord (112) is likely an alternating current at some standard voltage.

In the United States, the power provided through the power cord (112) is an alternating current provided at 110 V. This voltage is not directly usable by the internal components of the printer (114). In order to transform the incoming power from the power cord (112) to a level useable by the internal components of the printer (114), the power is processed through the AC power supply (130).

In the AC power supply (130), for example, a transformer preferably reduces the voltage by a combination of wire windings around a ferromagnetic core. Once the transformer reduces the voltage, the alternating current (102) is then output to a print head power supply (128).

The print head power supply (128) includes a number of diodes that rectify the alternating current to convert it from an alternating current (AC) to a direct current (DC). The print head power supply (128) also selectively controls the voltage of the power (126) provided to the print head driver (116) and print head (122). When the power is reduced in voltage to the desired power level and is rectified, the power (126) is provided to the print head driver (116) to power the driver (116) and print head (122).

As indicated above, if the printer (114) is an inkjet printer, the print job will be rendered on a print medium, e.g., a sheet of paper, by selectively depositing drops or dots of ink or colorant on the print medium as the print head and print medium move relative to each other. Typically, a print job is printed one line or swath of dots at a time. The amount of power needed by the print head (122), e.g., the current drawn from the power system (128), will be directly related to the density of the dots the print head (122) is to print at any point in the execution of a print job.

According to principles of the embodiment of the present invention, the host system (110) also includes a printer driver (108). The printer driver (108) is a piece of software or firmware that is executed by the host system (110). When an application on the host system (110) is submitting a print job to the printer (114), the printer driver (108) renders the print job data in a format useable by the printer (114) and sends the print job data to the printer (114).

In this embodiment of the present invention, the printer driver (108) on the host system (110) will also analyze the print job data being sent to the printer (114) to determine how that data will, during the course of printing the print job, vary the current needed by the print head (122), i.e., the printing density. This will allow the power supply equipment in the printer (114) to anticipate and adjust for sudden increases in current demand. Consequently, the average voltage level of the power supply equipment will not have to be held constantly high enough to accommodate transient jumps in current demand.

The printer driver (108) can measure printing density by counting the entire swath of dots included in the print job prior to printing. Alternatively, the printer driver (108) may count the dots in a line just before that line is printed. The number of dots is directly proportional to the current used by the print head (122) to print those dots.

The information representing the dot count and possibly other information, such as space within the document where no printing will occur, is then packeted by the printer driver (108) and transmitted to the printer (114). Packet is to be understood to mean data transmitted but not interpreted as specific to a topology or common protocol. This transmission (120) may occur once with each print job or may be an ongoing series of transmissions throughout the printing of a print job. The packeted information is sent to the microprocessor (118) in the printer hardware (114).

Figure 2:
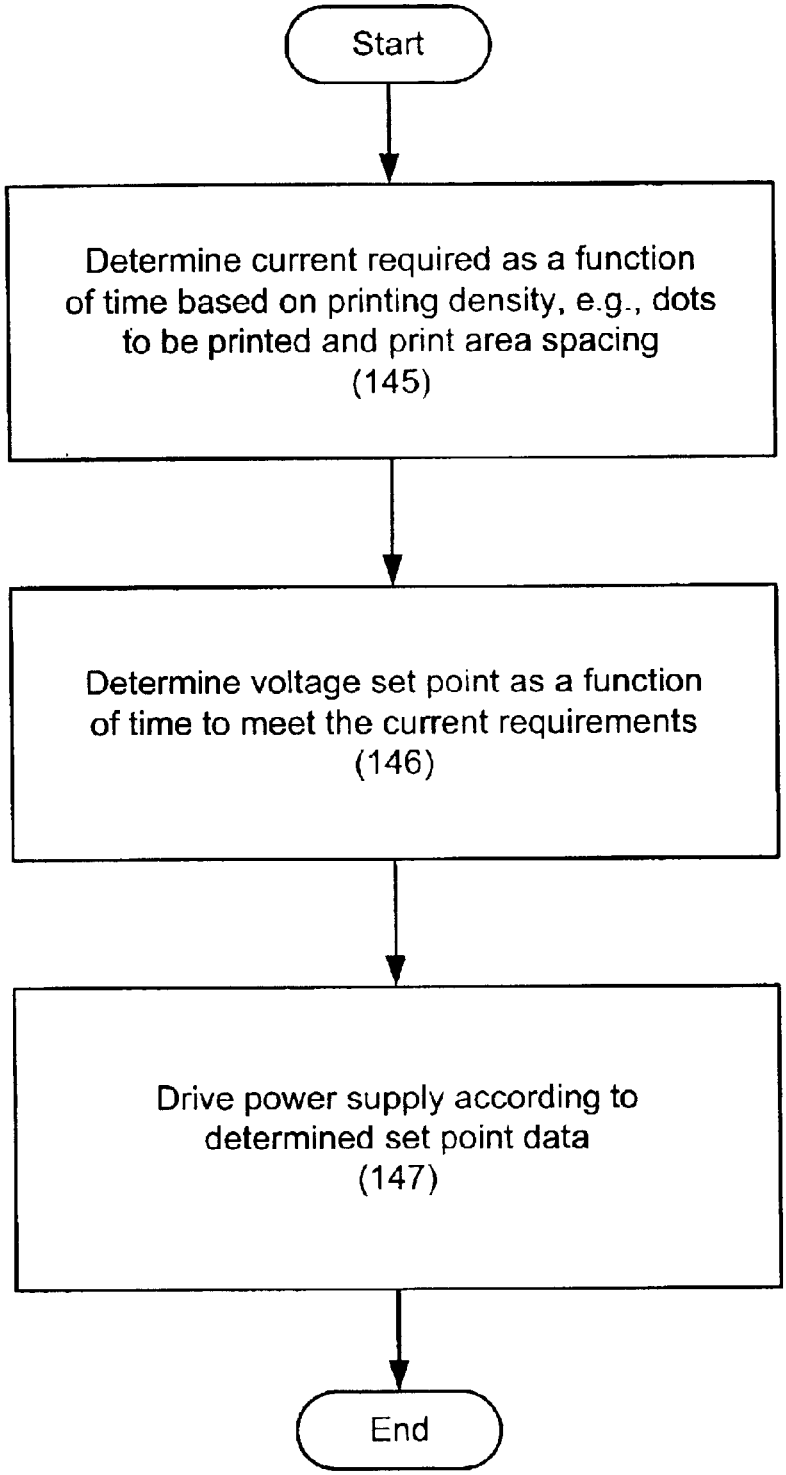
FIG. 2 is a flowchart illustrating an algorithm for anticipating power needs used in an embodiment of the present invention.

The microprocessor (118) receives the packeted information and uses that information to determine what the power needs of the print head (122) will be, i.e., what currents the print head (122) will draw during execution of the print job. This algorithm is preferably programmed for execution by the microprocessor (118) and is illustrated in FIG. 2. As shown on FIG. 2, the microprocessor first uses the packeted information received from the printer driver (108: FIG. 1) to determine what the current needs of the print head will be as a function of time. (145). This is a straightforward calculation based on the power-use specifics of the print head, which will be known, and the print data, e.g., the number of dots used in the printed areas of the print job, the spacing of non-printed areas within the print job, etc.

Next, the anticipated current needs of the print head are converted into a voltage set point used to provide the anticipated current draw at each instant in time throughout the print job. (146). A signal (124; FIG. 1) is then output by the microprocessor (118) to control the print head power supply (128; FIG. 1) so as to supply, as a function of time, the desired voltage and current to the print head (122; FIG. 1).

Figure 3:
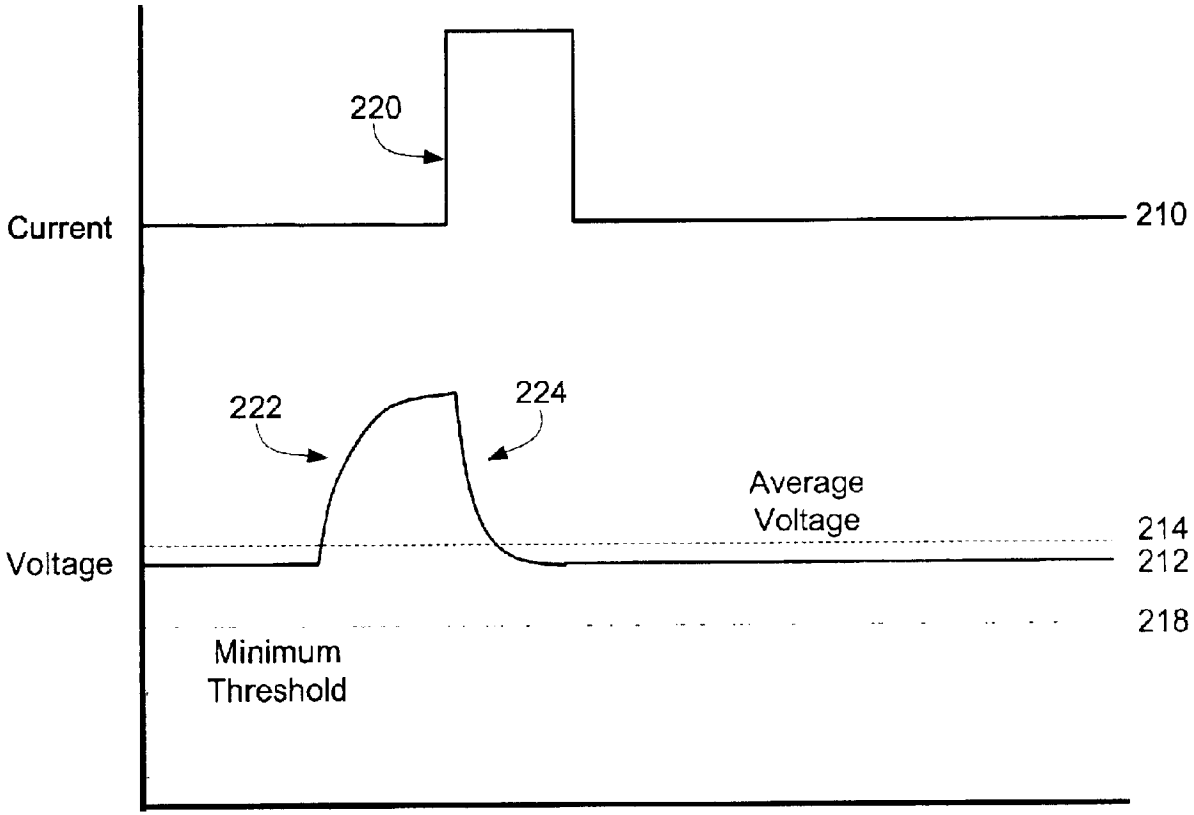
FIG. 3 is a graph showing an internal voltage and current condition plotted against time according to teachings of an embodiment of the current invention.

FIG. 3 demonstrates how an embodiment of the present invention anticipates the current draw of the print head thereby reducing the overall average voltage (214). As shown in FIG. 3, the current (210) drawn by the print head will include a step load (220). However, the information provided by the printer driver (108; FIG. 1) allows the anticipation of the step load (220). Prior to the occurrence of the step (220), the signal (124; FIG. 1) from the microprocessor (118; FIG. 1) will cause the print head power supply (128; FIG. 1) to gradually increase the voltage (126; FIG. 1) supplied to the print head (116, 122; FIG. 1). This gradual increase (222) is shown in FIG. 3.

When the step load (220) occurs, the voltage (212) is high enough to provide the current needed by the print head to handle the step load (220). After the step load (220) has passed, the voltage (212) output to the print head (116, 122; FIG. 1) is again decreased (224) to a lower level.

As a result of being able to anticipate when the voltage must be raised to accommodate a step load or other increased demand for current, the average voltage (214) is less than it would be otherwise, see e.g., FIG. 6. Additionally, the voltage supplied (212) may be below the average voltage a majority of the time the print job is being executed. As indicated above, this makes the printer more power-efficient and prolongs the useful life of the print head.

Figure 4:
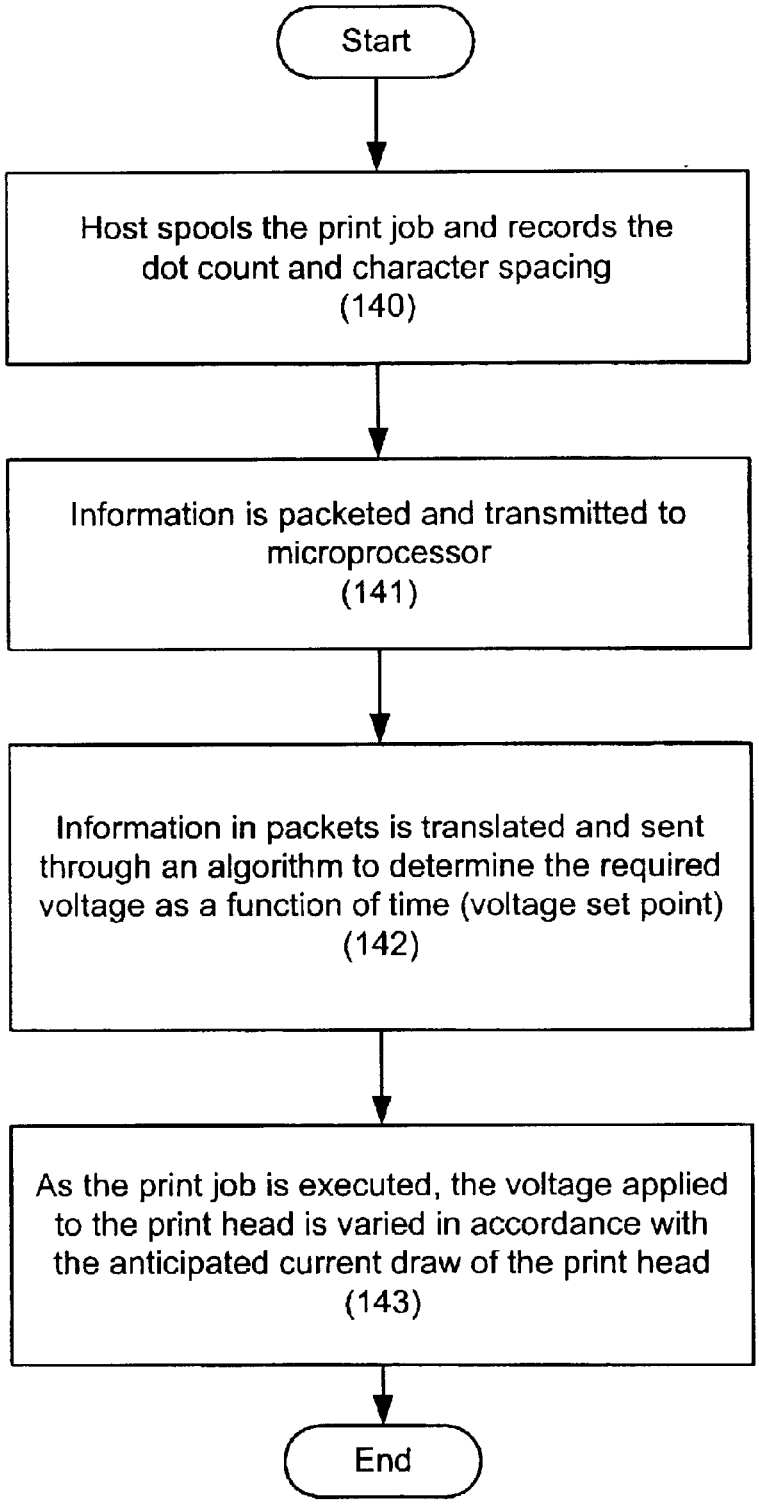
FIG. 4 is a schematic block diagram of the print data flow according to an embodiment of the present invention.

FIG. 4, in summary, illustrates a method that is one possible embodiment of the present invention. As shown in FIG. 4, the host, or more precisely the printer driver running on the host, spools the print job and records print density information such as dot density or count, character spacing, unprinted areas, etc. (140). This information is packeted and transmitted to then printer for use in anticipating the current demands of the print head. (141). The information is then used by the microprocessor in the printer as input for an algorithm (e.g., FIG. 2) that uses the information to anticipate how the current drawn by the print head will vary as a function of time during the execution of the print job. (142). Then, as the print job is executed, the voltage applied to the print head is varied in accordance with the anticipated current draw of the print head. (143).

Figure 5:
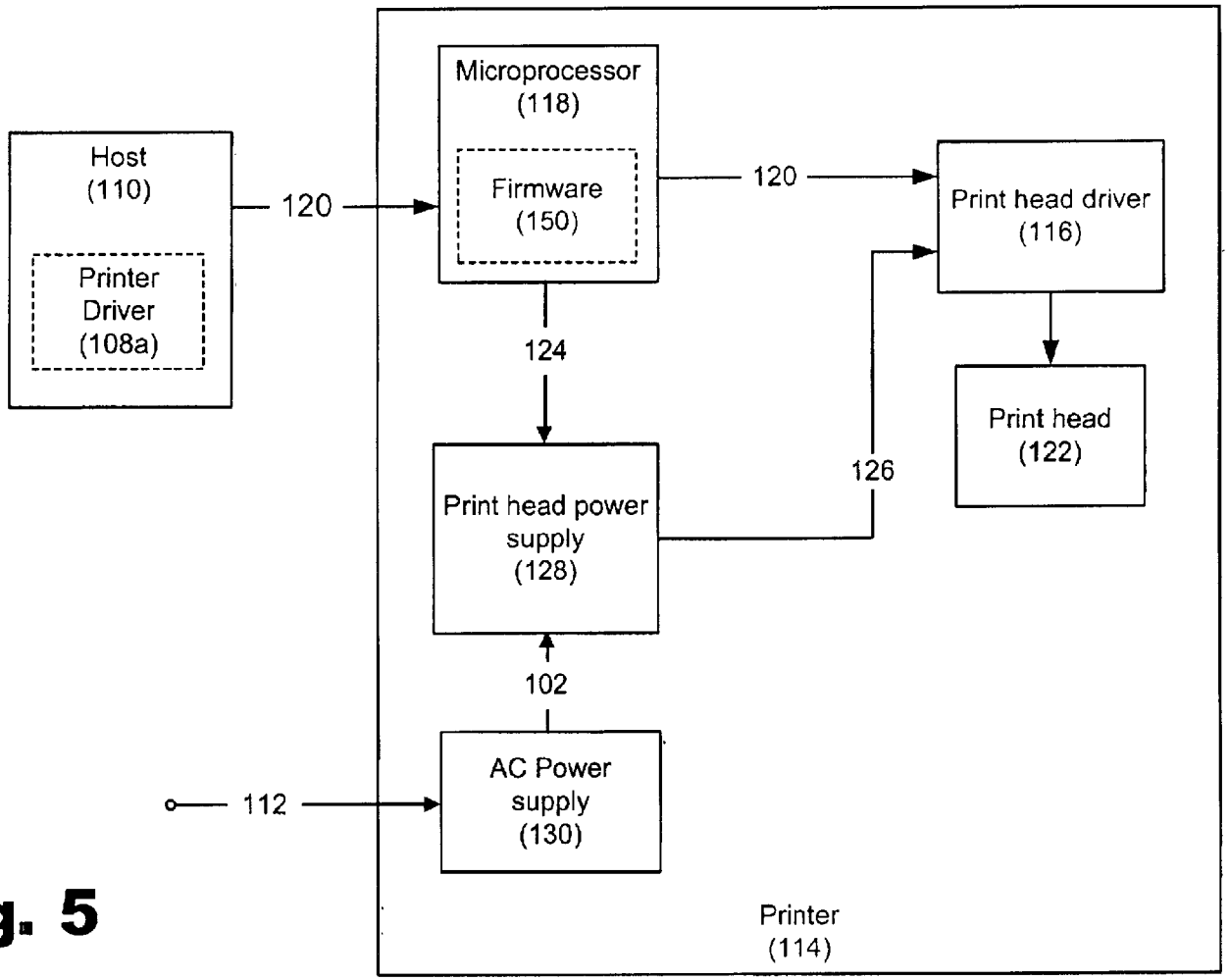
FIG. 5 is a schematic block diagram of an ink jet printing device according to another embodiment of the invention.

FIG. 5 illustrates another embodiment of a system for reducing the average voltage set point of a power supply according to principles of the embodiment of the present invention. As shown in FIG. 5, such a voltage reducing system is preferably implemented in a printer (114). Although, the present invention has other applications.

As before, the printer (114) receives print job data from a host system (110) and prints a hardcopy product from that print job data. The printer (114) preferably contains, or has access to, a supply of a print medium, such as paper, on which print jobs can be printed. The printed product is then output by the printer (114).

The host system (110) may be a computer or a computer network that sends print jobs to the printer (114) for execution. The host (110) can be, for example, a personal computer or other device connected directly to the printer (114). Alternatively, the host (110) may be a number of computers, servers or other devices connected to the printer (114) through a network such as a Local Area Network (LAN), Wide Area Network (WAN), the Internet, a wireless network, etc. Any configuration in which one or more host devices communicate print job data to the printer (114) can benefit from implementation of the present invention.

The printer (114) preferably includes a microprocessor (118) that processes print job data (120) from the host (110) and controls the operation of the printer (114). The printer (114) also preferably includes a print head (122) and a print head driver (116). The print head driver (116) positions and drives the print head (112). The print data (120) is passed from the microprocessor (118) to the print head driver (116).

These internal components of the printer (114) are powered by a system which includes a power cord (112), an alternating current (AC) power supply (130) and a print head power supply (128). This power system is similar to that described above. The printer (114) receives power through the power cord (112). This power cord (112) is, for example, connected to a wall outlet in a home or office where the printer (114) is located. Consequently, the power provided through cord (112) is likely an alternating current at some standard voltage.

As explained above, the power provided through the power cord (112) may be an alternating current provided at, for example, 110 V. This voltage is not directly usable by the internal components of the printer (114). In order to transform the incoming power from the power cord (112) to a level useable by the internal components of the printer (114), the power is processed through the AC power supply (130). In the AC power supply (130), for example, a transformer preferably reduces the voltage by a combination of wire windings around a ferromagnetic core. Once the transformer reduces the voltage, the alternating current (102) is then output to a print head power supply (128).

The print head power supply (128) includes a number of diodes that rectify the alternating current to convert it from an alternating current (AC) to a direct current (DC). The print head power supply (128) also selectively controls the voltage of the power (126) provided to the print head driver (116) and print head (122). When the power is reduced in voltage to the desired power level and is rectified, the power (126) is provided to the print head driver (116) to power the driver (116) and print head (122).

As indicated above, if the printer (114) is an inkjet printer, the print job will be rendered on a print medium, e.g., a sheet of paper, by selectively depositing drops or dots of ink or colorant on the print medium as the print head and print medium move relative to each other. Typically, a print job is printed one line of dots at a time. The amount of power needed by the print head (122), e.g., the current drawn from the power system (128), will be directly related to the density of the dots the print head (122) will print at any point in the execution of a print job.

According to principles of the embodiment of the present invention, the microprocessor (118) of the printer (114) includes a firmware image (150). The firmware (150) is the set of instructions executed by the microprocessor (118) to control operation of the printer (114). When an application on the host system (110) is submitting a print job to the printer (114), a printer driver **(108*a*) on the host (110) renders the print job data in a format useable by the printer (114) and sends the print job data to the printer (114)**.

In this embodiment of the present invention, the firmware (150) includes an algorithm that causes the microprocessor to analyze the print job data being sent to the printer (114) from the host (110). This algorithm of the firmware (150) determines how that data will, during the course of printing the print job, vary the current needed by the print head (122), i.e., the printing density. This will allow the power supply equipment in the printer (114) to anticipate and adjust for sudden increases in current demand. Consequently, the average voltage level of the power supply equipment will not have to be held constantly high enough to accommodate transient jumps in current demand.

The firmware (150) can measure printing density by counting the entire swath of dots included in the print job prior to printing. Alternatively, the firmware (150) may count the dots in a line just before that line is printed. The number of dots is directly proportional to the current used by the print head (122) to print those dots.

The information representing the dot count and possibly other information, such as space within the document where no printing will occur, is generated by the firmware (150). The firmware (150) then uses this information to determine what the power needs of the print head (122) will be, i.e., what currents the print head (122) will draw during execution of the print job. This algorithm of the firmware (150) is as illustrated in FIG. 2. As shown on FIG. 2, the algorithm first uses the information generated by measuring print job density to determine what the current needs of the print head will be as a function of time. (145). This is a straightforward calculation based on the power-use specifics of the print head, which will be known, and the print data, e.g., the number of dots included in the printed areas of the print job, the spacing of non-printed areas within the print job, etc.

Next, the anticipated current needs of the print head are converted into a voltage set point used to provide the anticipated current draw at each instant in time throughout the print job. (146). A signal (124; FIG. 5) is then output by the microprocessor (118) to control the print head power supply (128; FIG. 5) so as to supply, as a function of time, the desired voltage and current to the print head (122; FIG. 5).

The preceding description has been presented only to illustrate and describe the invention. It is not intended to be exhaustive or to limit the invention to any precise form disclosed. Many modifications and variations are possible in light of the above teaching. It is intended that the scope of the invention be defined by the following claims.

What is claimed is:

1. A method of providing power to a print head, said method comprising:

determining a printing density at times throughout a print job based on data representing said print job;

transmitting a measurement of said printing density to a printer; and controlling said power applied to said print head in accordance with said measurement of said printing density.

2. The method of claim 1, wherein controlling said power applied to said print head includes controlling a voltage applied to said print head.

3. The method of claim 2, wherein said determining a printing density comprises counting a number of dots used to print said print job data at said times throughout said print job.

4. A method of providing power to print head, said method comprising:

determining a printing density at times throughout a print job based on data representing said print job;

transmitting a measurement of said printing density to a printer; and controlling said power applied to said print head in accordance with said measurement of said printing density;

wherein controlling said power applied to said print head includes controlling a voltage applied to said print head;

wherein said controlling a voltage applied to said print head further comprises increasing said voltage applied to said print head prior to printing a portion of said print job having an increased measurement of said printing density.

5. The method of claim 4, further comprising decreasing said voltage applied to said print head after printing said portion of said print job having an increased measurement of said printing density.

6. The method of claim 2, wherein said controlling a voltage applied to said print head further comprises inputting said measurement of said printing density to an algorithm executed by a processor in said printer, said algorithm outputting an indication of a voltage level corresponding to said measurement of print density at said times throughout said print job, said indication of voltage level being used to regulate a voltage applied to said print head.

7. A method of providing power to print head, said method comprising:

determining a printing density at times throughout a print job based on data representing said print job;

transmitting a measurement of said printing density to a printer; and controlling said power applied to said print head in accordance with said measurement of said printing density;

wherein said determining said printing density at said times throughout a print job is performed by a printer driver executing on a host that submits said print job to said printer.

8. A system for anticipating power needs of a print head in a printer, said system comprising:

a host communicating with said printer for submitting a print job to said printer;

a printer driver executing on said host, said printer driver determining print density as a function of time based on data representing said print job and transmitting a measurement of print density as a function of time to said printer; and said printer, further comprising a processor, said print head and a power system for supplying power to said print head;

wherein said processor receives said measurement of print density and controls a voltage applied by said power system to said print head in accordance with said measurement of print density.

9. The system of claim 8, wherein said print head comprises a print head and a print head driver for positioning and driving said print head.

10. The system of claim 8, wherein said power system further comprises a power cord providing power from a wall outlet to an alternating current power supply in said printer, wherein said alternating current power supply steps down a voltage of said power from said power cord.

11. The system of claim 10, further comprising a print head power supply for rectifying an alternating current provided by said alternating current power supply and selectively outputting a voltage to said print head under control of said processor in accordance with said measurement of print density.

12. The system of claim 9, further comprising a network by which said host communicates with said printer.

13. A system for providing power to a print head, said system comprising:

means for determining a density of printing at points in time throughout a print job based on data representing said print job;

means for transmitting a measurement of said printing density to a printer also receiving said print job data; and means for controlling a voltage applied to said print head in accordance with said measurement of said printing density.

14. The system of claim 13, wherein said means for determining a density of printing comprise means for counting a number of dots used to print said print job data at said points in time throughout said print job.

15. The system of claim 13, wherein said means for controlling a voltage applied to said print head further comprise means for executing an algorithm that receives as input said measurement of said printing density and outputs an indication of a voltage level corresponding to said measurement of print density at each point in time throughout said print job, said indication of voltage level being used to regulate a voltage applied to said print head.

16. A system for providing power to a print head, said system comprising:

means for determining density of printing at points in time throughout print job based on data representing said print job;

means for transmitting measurement of said printing density to a printer also receiving said print job data; and means for controlling a voltage applied to said print head in accordance with said measurement of said printing density;

wherein said means for controlling a voltage applied to said print head further comprise means for increasing said voltage applied to said print head prior to printing a portion of said print job having an increased measurement of printing density.

17. The system of claim 16, further comprising means for decreasing said voltage applied to said print head after printing said portion of said print job having an increased measurement of printing density.

18. A system for providing power to a print head, said system comprising:

means for determining a density of printing at points in time throughout a print job based on data representing said print job;

means for transmitting a measurement of said printing density to a printer also receiving said print job data; and means for controlling a voltage applied to said print head in accordance with said measurement of said printing density;

wherein said means for determining a density of printing at each point in time throughout a print job comprises a printer driver executing on a host that submits said print job to said printer.

19. Computer-readable instructions stored on a medium, said instructions comprising a printer driver such that said instructions, when executed, cause a processor to:

determine a density of printing at times throughout a print job based on data representing said print job; and transmit a measurement of said printing density to a printer.

20. The instructions of claim 19, wherein said instructions further cause a processor to determine a density of printing by counting a number of dots used to print said print job data at said times throughout said print job.

21. Computer-readable instructions stored on a medium, said instructions comprising firmware for controlling a voltage applied to a print head in a printer such that said instructions, when executed, cause a processor in said printer to:

receive as input a measurement of printing density as a function of time generated by a printer driver executing on a host submitting a print job to said printer;

output an indication of a voltage level corresponding to said measurement of print density at times throughout said print job; and use said indication of voltage level to regulate a voltage applied to said print head.

22. The instructions of claim 21, wherein said instructions further cause said processor to increase said voltage applied to said print head prior to printing a portion of said print job having an increased measurement of printing density.

23. The instructions of claim 21, wherein said instructions further cause said processor to decrease said voltage applied to said print head after printing said portion of said print job having an increased measurement of printing density.

24. A system for anticipating power needs of a print head in a printer, said system comprising:

a host communicating with said printer for submitting a print job to said printer;

said printer, further comprising a processor, said print head and a power system for supplying power to said print head; and a firmware image for execution by said processor of said printer, said firmware image determining print density as a function of time based on data representing said print job;

wherein said processor measures print density and controls a voltage applied by said power system to said print head in accordance with said measurement of print density.

25. The system of claim 24, wherein said print head comprises a print head and a print head driver for positioning and driving said print head.

26. The system of claim 24, wherein said power system further comprises a power cord providing power from a wall outlet to an alternating current power supply in said printer, wherein said alternating current power supply steps down a voltage of said power from said power cord.

27. The system of claim 26, further comprising a print head power supply for rectifying an alternating current provided by said alternating current power supply and selectively outputting a voltage to said print head under control of said processor in accordance with said measurement of print density.

28. The system of claim 24, further comprising a network by which said host communicates with said printer.

29. A method for anticipating power needs of a print head in a printer, said printer comprising a processor, said print head and a power system for supplying power to said print head, said method comprising:

executing a firmware image on said processor of said printer, wherein said firmware image:

receives print job data from a host communicating with said printer;

determines print density as a function of time based on said print job data; and controls a voltage applied by said power system to said print head in accordance with said print density.

30. The method of claim 29, further comprising powering said print head in accordance with said voltage controlled by said firmware image to print a print job represented by said print job data.

31. The method of claim 30, wherein said powering said print head further comprises providing power from a wall outlet to an alternating current power supply in said printer, wherein said alternating current power supply steps down a voltage of said power from said power cord.

32. The method of claim 31, further comprising:

rectifying an alternating current provided by said alternating current power supply; and selectively outputting a voltage to said print head under control of said firmware in accordance with said print density.

33. Computer-readable instructions stored on a medium, said instructions comprising firmware for controlling a voltage applied to a print head in a printer such that said instructions, when executed, cause a processor in said printer to:

generate a measurement of printing density as a function of time from print job data representing a print job submitted to said printer by a host;

determine a voltage level corresponding to said measurement of print density at each point in time throughout said print job; and regulate a voltage applied to said print head according to said voltage level corresponding to said measurement of print density at each point in time throughout said print job.

34. The instructions of claim 33, wherein said instructions further cause said processor to increase said voltage applied to said print head prior to printing a portion of said print job having an increased measurement of printing density.

35. The instructions of claim 34, wherein said instructions further cause said processor to decrease said voltage applied to said print head after printing said portion of said print job having an increased measurement of printing density.

36. A printer for anticipating power needs of a print head, wherein said printer receives a print job and a measurement of print density as a function of time for the print job from a printer driver that determines print density as a function of time based on data representing the print job, said printer comprising:

a processor for receiving a print job;

a print head; and a power system for supplying power to said print head;

wherein said processor controls a voltage applied by said power system to said print head in accordance with said measurement of print density.

37. The printer of claim 36, wherein said print head comprises a print head and a print head driver for positioning and driving said print head.

38. A printer for anticipating power needs of a print head, wherein said printer receives a print job and a measurement of print density as a function of time for the print job from a printer driver that determines print density as a function of time based on data representing the print job, said printer comprising:

a processor for receiving a print job;

a print head; and a power system for supplying power to said print head;

wherein said processor controls a voltage applied by said power system to said print head in accordance with said measurement of print density;

wherein said power system further comprises a power cord providing power from a wall outlet to an alternating current power supply in said printer, wherein said alternating current power supply steps down a voltage of said power from said power cord.

39. The system of claim 38, further comprising a print head power supply for rectifying an alternating current provided by said alternating current power supply and selectively outputting a voltage to said print head under control of said processor in accordance with said measurement of print density.

40. A system for anticipating power needs of a print head in a printer, said system comprising:

a host for submitting a print job to a printer; and a printer driver executing on said host, said printer driver determining print density as a function of time based on data representing said print job and transmitting a measurement of print density as a function of time to said printer;

wherein said printer receives said measurement of print density and controls a voltage applied to said print head in accordance with said measurement of print density.

41. A method of providing power to a print head, said method comprising:

determining a printing density at times all throughout a print job based on electronic data representing said print job; and, while printing said print job, controlling said power applied to said print head in accordance with said measurement of said printing density.

42. The method of claim 41, wherein controlling said power applied to said print head includes controlling a voltage applied to said print head.

43. The method of claim 42, wherein said determining a printing density comprises counting a number of dots used to print said print job data at said times all throughout said print job.

44. The method of claim 42, wherein said controlling a voltage applied to said print head further comprises increasing said voltage applied to said print head prior to printing a portion of said print job having an increased measurement of said printing density.

45. The method of claim 44, further comprising decreasing said voltage applied to said print head after printing said portion of said print job having an increased measurement of said printing density.

46. The method of claim 42, wherein said controlling a voltage applied to said print head further comprises inputting said measurement of said printing density to an algorithm executed by a processor in said printer, said algorithm outputting an indication of a voltage level corresponding to said measurement of print density at said times throughout said print job, said indication of voltage level being used to regulate a voltage applied to said print head.

47. The method of claim 41, wherein said determining said printing density at said times all throughout a print job is performed by a printer driver executing on a host that submits said print job to said printer.

* * * * *